US007731064B2

(12) United States Patent
Chuang et al.

(10) Patent No.: US 7,731,064 B2
(45) Date of Patent: Jun. 8, 2010

(54) WATER GUNS

(75) Inventors: Peter Chuang, Placentia, CA (US); George Eden, West Hollywood, CA (US); Kevin Hou, ShenZhen (CN); Francis Ponton, Bellflower, CA (US); Chiu Wah Wong, Hong Kong (CN)

(73) Assignee: Mattel, Inc., El Segundo, CA (US)

( * ) Notice: Subject to any disclaimer, the term of this patent is extended or adjusted under 35 U.S.C. 154(b) by 962 days.

(21) Appl. No.: 11/366,087

(22) Filed: Mar. 1, 2006

(65) Prior Publication Data

US 2006/0226262 A1 Oct. 12, 2006

Related U.S. Application Data

(60) Provisional application No. 60/687,358, filed on Jun. 3, 2005, provisional application No. 60/670,778, filed on Apr. 12, 2005.

(30) Foreign Application Priority Data

| | | |
|---|---|---|
| Aug. 1, 2005 | (EP) | 000379961-0009 |
| Aug. 1, 2005 | (EP) | 000379961-0010 |
| Aug. 1, 2005 | (EP) | 000379961-0011 |
| Aug. 1, 2005 | (EP) | 000379961-0012 |
| Aug. 1, 2005 | (EP) | 000379961-0013 |
| Aug. 1, 2005 | (EP) | 000379961-0014 |

(51) Int. Cl.
*B65D 88/54* (2006.01)

(52) U.S. Cl. ..... 222/321.1; 222/79; 222/175; 222/324; 222/372; 239/288; 239/456; 239/525; 273/349; 446/18; 446/153; 446/180; 446/197

(58) Field of Classification Search ..... 222/78–79, 222/175, 192, 320, 321.1, 322, 323, 324, 222/372; 89/36.01, 36.07; 273/349; 239/288, 239/456, 525–526; 446/15–16, 18, 153, 446/180, 197, 473, 475, 483
See application file for complete search history.

(56) References Cited

U.S. PATENT DOCUMENTS

| | | | | |
|---|---|---|---|---|
| 295,013 | A | | 3/1884 | Hunter |
| 391,397 | A | | 10/1888 | Berkeley |
| 1,244,679 | A | | 10/1917 | Winn |
| 1,279,930 | A | | 9/1918 | Stroud |
| 1,290,606 | A | | 1/1919 | Lovas |
| 2,306,708 | A | | 12/1942 | Mendel |
| 2,941,695 | A | * | 6/1960 | Rich ..... 222/132 |
| 3,038,483 | A | | 6/1962 | Altsheler |
| 3,578,789 | A | | 5/1971 | Ferri |
| 3,685,828 | A | | 8/1972 | Getgey et al. |
| 3,828,478 | A | | 8/1974 | Bemis |
| 4,040,622 | A | | 8/1977 | Sinnott |
| 4,214,674 | A | | 7/1980 | Jones et al. |
| 4,358,984 | A | | 11/1982 | Winblad |
| 4,412,495 | A | | 11/1983 | Sankar |
| 4,573,975 | A | | 3/1986 | Frist et al. |
| 4,591,071 | A | * | 5/1986 | Johnson ..... 222/39 |
| 4,743,030 | A | * | 5/1988 | Auer et al. ..... 273/349 |
| 4,815,822 | A | | 3/1989 | Bramhall |
| 5,029,732 | A | | 7/1991 | Wong |
| 5,042,819 | A | * | 8/1991 | LaFata ..... 273/349 |
| 5,102,052 | A | | 4/1992 | Demarest et al. |
| 5,150,819 | A | * | 9/1992 | Johnson et al. ..... 222/79 |
| D331,609 | S | * | 12/1992 | LaFata ..... D21/401 |
| 5,172,863 | A | * | 12/1992 | Melone et al. ..... 239/211 |
| 5,241,944 | A | | 9/1993 | Rappaport |
| 5,288,231 | A | | 2/1994 | Kuehn et al. |
| 5,316,182 | A | * | 5/1994 | Lee et al. ..... 222/78 |
| 5,320,231 | A | * | 6/1994 | Iodice ..... 215/385 |
| 5,332,120 | A | | 7/1994 | D'Andrade et al. |
| 5,377,656 | A | | 1/1995 | Lewinski et al. |
| 5,411,269 | A | | 5/1995 | Thomas |
| 5,598,950 | A | | 2/1997 | Liu et al. |
| 5,605,253 | A | | 2/1997 | Luk |

| | | | | | |
|---|---|---|---|---|---|
| 5,611,460 | A | | 3/1997 | Rudell | |
| 5,641,934 | A | | 6/1997 | Follett | |
| 5,730,325 | A | * | 3/1998 | Cheung | 222/79 |
| 5,823,849 | A | | 10/1998 | Gardner et al. | |
| 5,865,438 | A | | 2/1999 | Zilliox | |
| 5,878,734 | A | * | 3/1999 | Johnson et al. | 124/59 |
| 5,944,006 | A | * | 8/1999 | Moore et al. | 124/65 |
| 6,312,364 | B1 | | 11/2001 | Selsam | |
| 6,474,507 | B1 | * | 11/2002 | Hornsby et al. | 222/79 |
| 6,730,004 | B2 | | 5/2004 | Selsam | |
| D514,173 | S | * | 1/2006 | McBride et al. | D21/572 |
| D548,290 | S | * | 8/2007 | Chuang et al. | D21/572 |
| D548,805 | S | * | 8/2007 | Chuang et al. | D21/572 |
| D557,753 | S | * | 12/2007 | Chuang et al. | D21/572 |
| 2002/0132557 | A1 | * | 9/2002 | Yu | 446/475 |
| 2005/0184098 | A1 | * | 8/2005 | Dixon | 222/192 |
| 2006/0226262 | A1 | * | 10/2006 | Chuang et al. | 239/525 |
| 2007/0056986 | A1 | * | 3/2007 | Berman | 222/79 |

FOREIGN PATENT DOCUMENTS

| | | | |
|---|---|---|---|
| GB | 2145340 | A | 3/1985 |

OTHER PUBLICATIONS

"Water Gun," 21 page Unpublished Document describing information known to the applicants at the time of invention, prepared Jan. 2007 by Steven Hudnut, Reg. No. 57,786.

Ring, E.R., Senior Patent Examiner, Canadian Intellectual Property Office, Requisition by Examiner, Patent Application No. 2,536,419, dated Sep. 11, 2007.

Instituto Mexicano de la Propiedad Industrial; Office Action issued in corresponding Mexican Patent Application Serial No. PA/a/2006/001785; dated Aug. 13, 2009.

Basham, Ringe y Correa S.C.; Foreign agent's summary of Office Action issued August 13, 2009 in corresponding Mexican Patent Application Serial No. PA/a/2006/001785; dated Sep. 23, 2009.

* cited by examiner

*Primary Examiner*—Kevin P Shaver
*Assistant Examiner*—Andrew P Bainbridge
(74) *Attorney, Agent, or Firm*—Kolisch Hartwell, P.C.

(57) ABSTRACT

A water gun may comprise a body having a front surface, a nozzle mounted on and extending from the body, an actuator, at least one fluid reservoir, and a pump. The nozzle may have at least a nozzle portion adapted to move between an extended position spaced away from the front surface and a retracted position closer to the front surface than the extended position. The actuator may be adapted to be moved relative to the body, and mechanically coupled to the nozzle for moving the nozzle between the retracted and extended positions when the actuator is moved between first and second positions. The fluid reservoir may comprise first and second end portions and a generally uniform elongate intermediate portion extending between the first and second end portions, which may have volumes that are larger than the volume of the intermediate portion. The pump may be fluidly coupled to the at least one reservoir and the nozzle, with the pump being operable to discharge fluid received from the at least one reservoir through the a nozzle.

27 Claims, 6 Drawing Sheets

WATER GUNS

This application claims the benefit of U.S. Provisional Patent Application Ser. No. 60/687,358, filed Jun. 3, 2005 and U.S. Provisional Patent Application Ser. No. 60/670,778, filed Apr. 12, 2005. This application claims priority under 35 U.S.C. 119(a) to European Community Design Registrations No. 000379961-0009, 000379961-0010, 000379961-0011, 000379961-0012, 000379961-0013, and 000379961-0014, entitled "Toy Squirt Guns," filed with the Office for Harmonization in the Internal Market on Aug. 1, 2005. The complete disclosure of each of the above-identified patent applications and design registrations are hereby incorporated by reference in their entirety for all purposes.

BACKGROUND

The present disclosure relates generally to water guns and, more particularly, to water guns having an extendable nozzle and/or a fluid reservoir having an enlarged end, such as a dumbbell shaped fluid reservoir adapted for use as an operating handle.

Examples of water guns adapted to eject either individual spurts or continuous streams of water, are disclosed in U.S. Pat. Nos. 3,038,483, 3,578,789, 3,828,478, 4,040,622, 4,214,674, 5,029,732, 5,042,819, 5,102,052, 5,377,656, 5,332,120, 5,598,950, 5,611,460, 5,605,253, 5,823,849, and 5,865,438. Examples of a toy using a bellows component to produce bubbles are disclosed in U.S. Pat. Nos. 5,042,819 and D331,609. Examples of water guns with shields are disclosed in U.S. Pat. Nos. 3,038,483, 4,040,622, 5,435,569, 5,611,460, and 5,865,438 as well as in U.S. patent application Ser. Nos. 29/180,808 and 10/836,647. Examples of guns with shields are disclosed in U.S. Pat. Nos. 295,013, 391,397, 1,244,679, 1,279,930, 1,290,606, 2,306,708, 3,828,478, 4,358,984, 4,815,822, 5,288,231, 5,611,460, 5,823,849, and 5,865,438. Examples of guns with extendable shields are disclosed in U.S. Pat. Nos. 295,013, 1,244,679, 1,279,930, 2,306,708, and 4,358,984. Examples of water guns having one-way ball valves are disclosed in U.S. Pat. Nos. 3,578,789, 4,214,674, 5,029,732, 5,042,819, and 5,598,950, and U.K. Patent Application No. GB2145340A. The disclosures of these and all other publications referenced herein are incorporated by reference in their entirety for all purposes.

SUMMARY OF THE DISCLOSURE

In one example, a water gun may comprise a body having a front surface, a nozzle mounted on and extending from the body, and an actuator. The nozzle may have at least a nozzle portion adapted to move between an extended position spaced away from the front surface and a retracted position closer to the front surface than the extended position. The actuator may be adapted to be moved relative to the body, and mechanically coupled to the nozzle for moving the nozzle between the retracted and extended positions when the actuator is moved between first and second positions.

In one example, a water gun may comprise at least one fluid reservoir, a nozzle, and a pump. The fluid reservoir may comprise first and second end portions and a generally uniform elongate intermediate portion extending between the first and second end portions. The first and second end portions may have volumes that are larger than the volume of the intermediate portion. The pump may be fluidly coupled to the at least one reservoir and the nozzle, with the pump being operable to discharge fluid received from the at least one reservoir through the nozzle.

DETAILED DESCRIPTION

Figure 1:
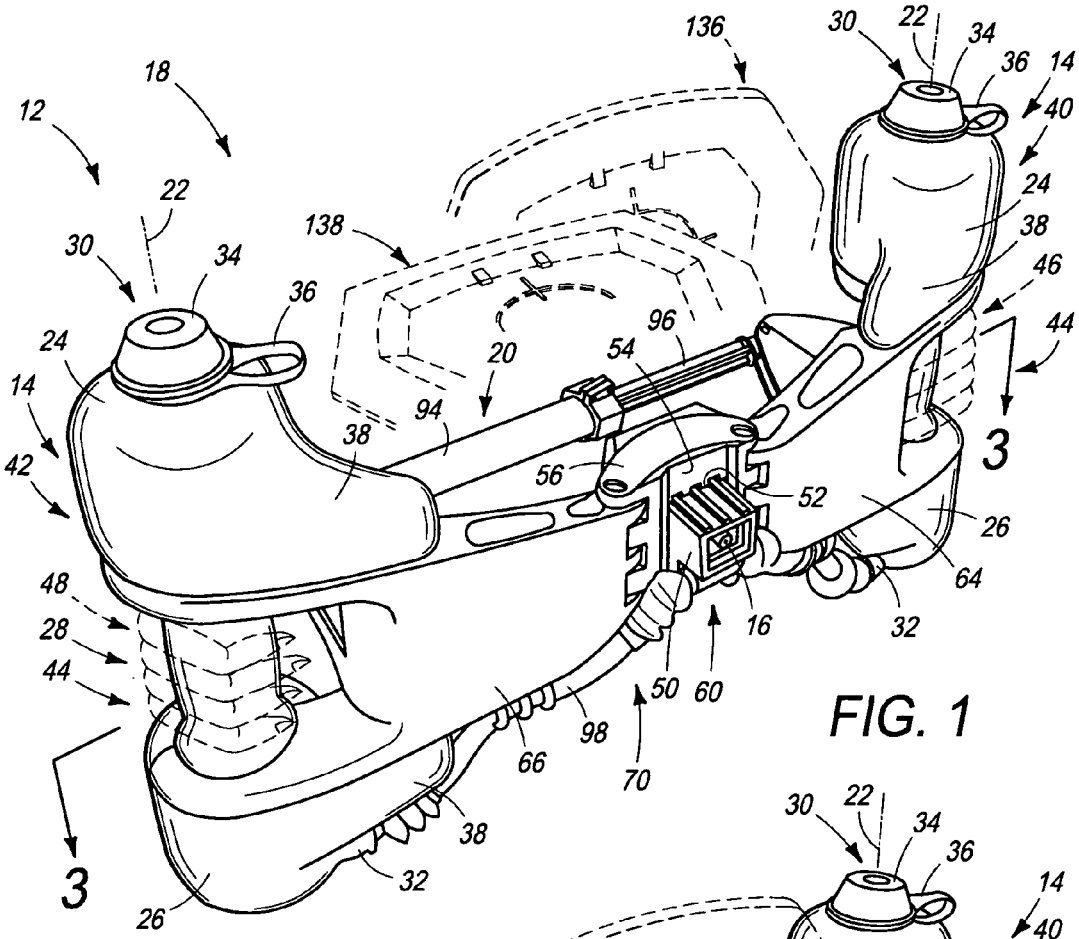
FIG. 1 is a top-front perspective view of an embodiment of a water gun shown with a nozzle in a retracted position.

An illustrative example of a water gun is shown generally at 12 in FIGS. 1-6. As shown in FIG. 1, water gun 12 may generally include a fluid source, such as one or more fluid reservoirs 14, a nozzle 16, an actuator 18, and a pump 20.

As depicted in FIG. 1, water gun 12 may be configured as a bellows-action water gun, although other suitable configurations may also be used. As more fully described below, a bellows-action water gun may, by alternate expansion and contraction, draw a suitable fluid, such as water or the like, from at least one fluid reservoir 14 and expel the fluid through a nozzle or other suitable opening.

One or more of the fluid reservoirs 14 may include multiple fluidly connected portions arranged along a longitudinal axis 22. For example, fluid reservoir 14 may include an upper or first end portion 24 and a lower or second end portion 26, which end portions are separated by an intermediate portion 28. The first and second end portions 24,26 and the intermediate portion 28 may be fluidly connected to collectively define a fluid containing body.

The fluid reservoir 14 may be fabricated from any suitable material such as a plastic or metal. At least one of fluid reservoirs 14 may include one or more transparent or translucent regions, which may be configured to allow a visual determination of the remaining level of fluid within fluid reservoir 14.

Each fluid reservoir 14 may include a filler opening 30 and an outlet 32. The filler opening 30 may be provided with a removable cap 34. Removable cap 34 may include one or more vents, which may be configured to relieve the pressure within fluid reservoir 14, such as to prevent formation of a vacuum within fluid reservoir 14. Removable cap 34 may attach to fluid reservoir 14 using a threaded or snap-on type connection. Removable cap 34 may be provided with a retainer 36 to keep the cap 34 attached to fluid reservoir 14, such as when a user is filling fluid reservoir 14.

As shown in FIG. 1, fluid reservoir 14 may resemble a dumbbell shape. When fluid reservoir 14 resembles a dumbbell shape, each of the first and second end portions 24, 26 may enclose a volume that is larger than the volume enclosed by the intermediate portion 28. In particular, at least one cross-sectional dimension, such as a diameter, of at least one of the first and second end portions 24, 26 may be larger than a cross-sectional dimension of the intermediate portion 28. As shown in FIG. 1, the first and second end portions 24, 26 may be larger than the intermediate portion 28 in each radial direction from longitudinal axis 22 extending through the intermediate portion 28 between the ends.

One or more of the first and second end portions 24, 26 and the intermediate portion 28 of fluid reservoir 14 may have a radially asymmetric cross-section relative to axis 22. As shown in FIG. 1, the first and second end portions 24, 26 may include one or more bulges or lobes 38. Lobes 38 may be configured to provide enhanced fluid capacity within a given physical envelope, or lobes 38 may allow the center of gravity of fluid reservoir 14 to be shifted, such as laterally away from longitudinal axis 22 of fluid reservoir 14.

The fluid reservoirs 14 may be configured into respective first and second fluid reservoirs 40, 42. In some embodiments, such as where the fluid reservoirs 14 include portions having a radially asymmetric cross-section relative to axis 22, the first and second fluid reservoirs 40, 42 may be configured so as to be mirror images of each other, as shown in FIG. 1.

The intermediate portion 28 of fluid reservoir 14 may include a generally uniform elongate portion extending between the first and second end portions 24, 26, as shown in FIG. 1. The intermediate portion 28 may have a reduced cross-section relative to at least one of the first or second end portions 24, 26. The intermediate portions 28 may be configured to provide handles 44 adapted to be grasped by human hands. For example, the first and second fluid reservoirs 40, 42 may be respectively grasped by first hand 46 and second hand 48, as shown in FIGS. 1 and 2.

The nozzle 16 may include an orifice for discharging a fluid and may be disposed on a nozzle housing 50 such that nozzle 16 may be at least partially integral with or carried by nozzle housing 50. The water gun 12 may also include a body or center housing 56 having an opening 52 in a front surface 54. The nozzle housing 50 may extend through opening 52 and may be supported by center housing 56, as shown in FIG. 1.

Figure 2:
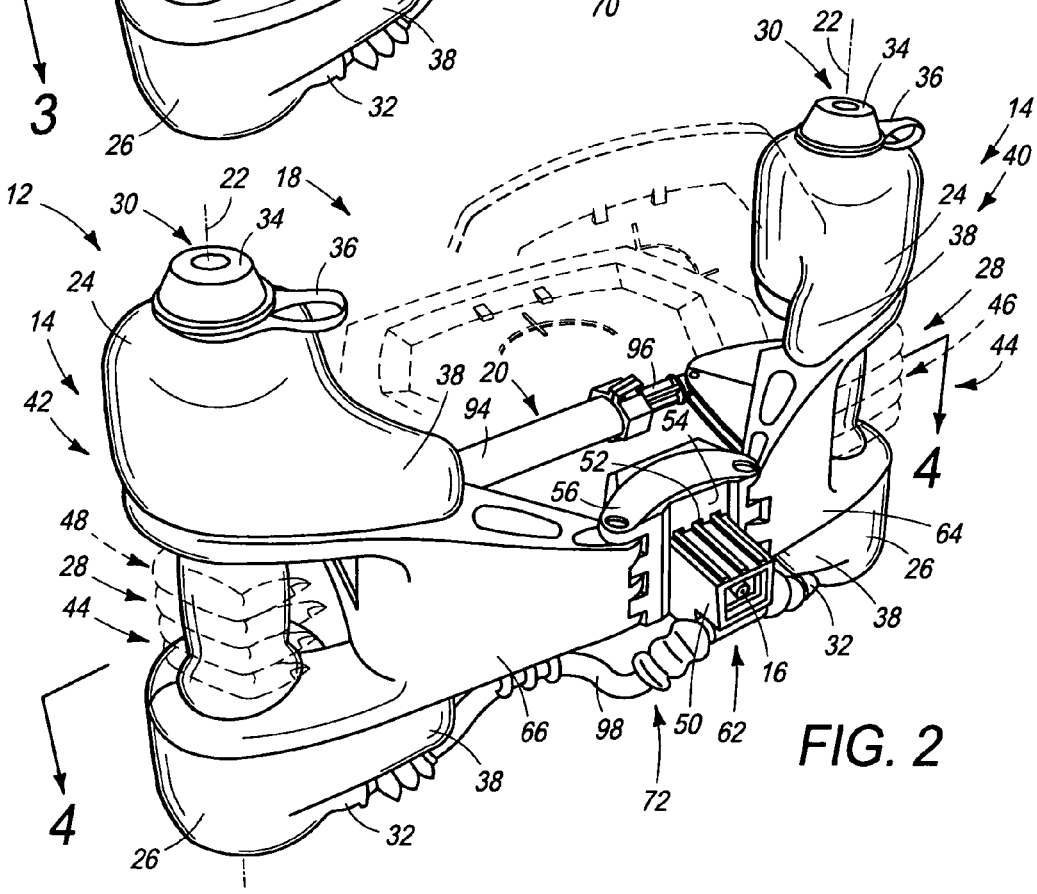
FIG. 2 is a top-front perspective view of the water gun of FIG. 1 shown with the nozzle in an extended position.
Figure 3:
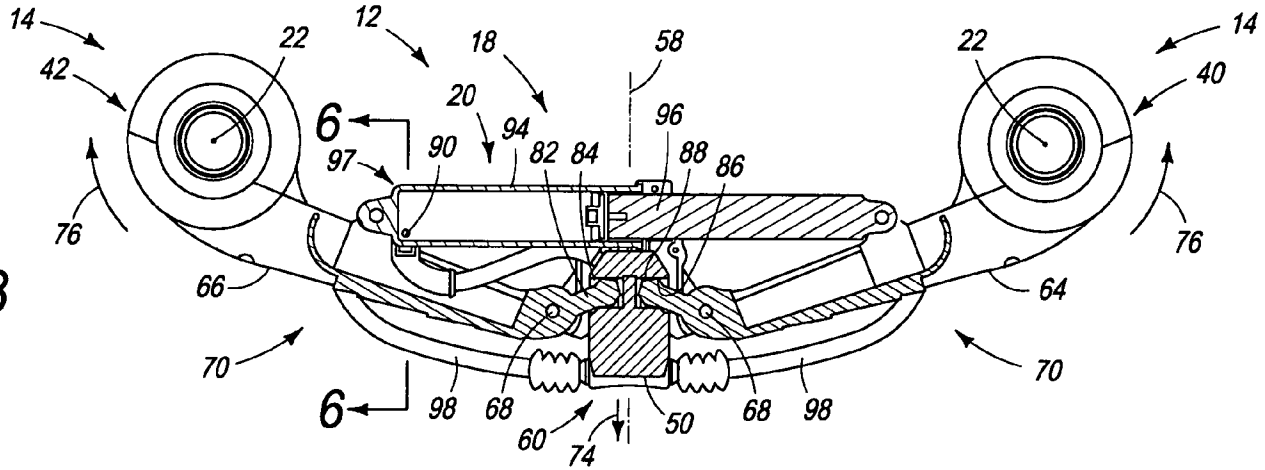
FIG. 3 is a section view of the water gun taken generally along line 3-3 in FIG. 1.
Figure 4:
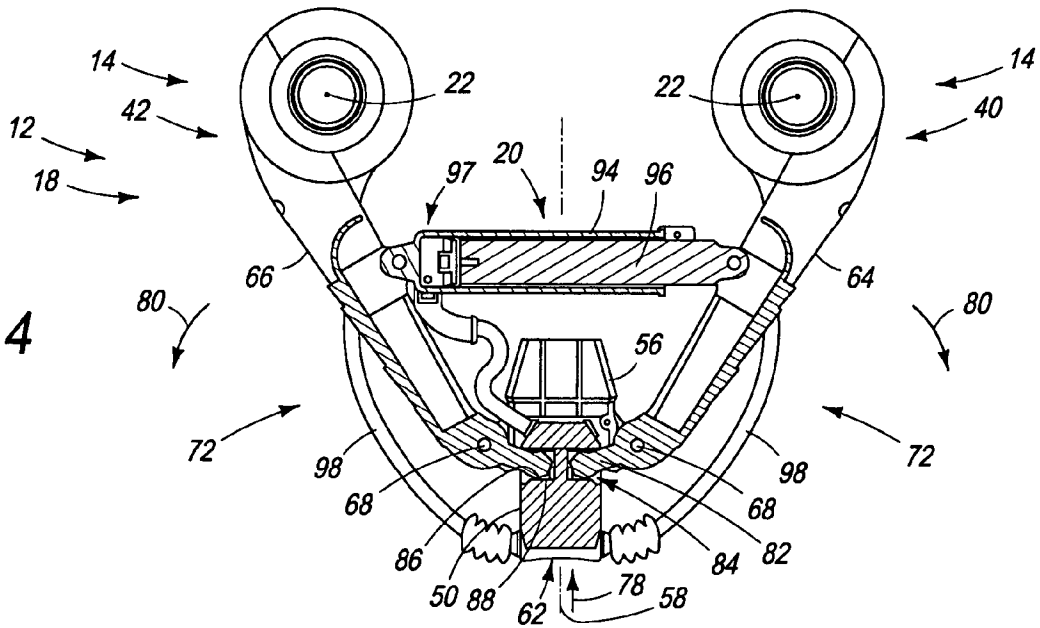
FIG. 4 is a section view of the water gun taken generally along line 4-4 in FIG. 2.

As may be observed by a comparison of FIGS. 1 and 2 or FIGS. 3 and 4, nozzle 16 may be configured to move relative to center housing 56, such as along the median plane of center housing 56, which is indicated by axis 58 in FIGS. 3 and 4. In particular, nozzle housing 50 may move relative to center housing 56, such as between a retracted position 60, as shown in FIGS. 1 and 3, and an extended position 62, as shown in FIGS. 2 and 4. In extended position 62, nozzle housing 50 may project outwardly from opening 52 such that at least a portion of nozzle housing 50 is spaced away from center housing 56. In contrast, in the retracted position 60, nozzle housing 50 may project outwardly from opening 52 to a lesser extent than when nozzle housing 50 is in extended position 62.

As illustrated in FIGS. 1 and 2, nozzle housing 50 may move along a rectilinear trajectory, represented by axis 58, as nozzle housing 50 moves between the retracted and extended positions 60, 62, such as where nozzle housing 50 slides in and out of opening 52 on the front surface 54 of center housing 56. In some embodiments not shown, nozzle housing 50 may be pivotingly attached to center housing 56 or other structure such that nozzle housing 50 may pivot between a retracted position and an extended position. The motion of nozzle housing 50 relative to center housing 56 may be a combination of rectilinear and rotational motion, or other suitable form of motion.

The nozzle 16 may be configured to selectably eject a fluid through at least one orifice. In some embodiments, nozzle 16 may be adjustable such as to provide one or more patterns of fluid ejection, such as a relatively concentrated stream, a relatively disperse spray, or a pulsating stream.

Actuator 18 may be any suitable structure that produces movement of nozzle housing 50 relative to center housing 56. Actuator 18 may include one or more members such as arms in the form of first and second housings 64, 66, as shown in FIG. 1. Each of first and second housings 64, 66 may be adapted to pivot relative to center housing 56, such as about a pivot pin 68, as shown in FIGS. 3 and 4. Any of these housings may include forward facing surfaces that shield or protect the water gun parts or the user. Otherwise, any of the housings may be any suitable support structure. Each of the respective first and second housings 64, 66 may be configured to move a portion, such as an end distal of pivot pin 68, between a first position 70, where the distal ends of each of the respective first and second housings 64, 66 are spaced away from the median plane, such as in opposite directions as shown in FIGS. 1 and 3, and a second position 72, where the distal ends of each of the respective first and second housings 64, 66 are closer to the median plane than in first position 70, as shown in FIGS. 2 and 4.

The first and second housings 64, 66 may be mechanically coupled to the nozzle 16 and/or the nozzle housing 50. The mechanical coupling between the first and second housings 64, 66 and the nozzle 16 and/or the nozzle housing 50 may cause the nozzle 16 and/or the nozzle housing 50 to transition from retracted position 60 to extended position 62, as suggested by arrow 74 in FIG. 3, as the first and second housings 64, 66 are brought toward each other and transitioned from first position 70 towards second position 72, as suggested by arrows 76 in FIG. 3. Conversely, the mechanical coupling may cause the nozzle 16 and/or the nozzle housing 50 to transition from extended position 62 to retracted position 60, as suggested by arrow 78 in FIG. 4, as the first and second housings 64, 66 are spread apart by transitioning from second position 72 toward first position 70, as suggested by arrows 80 in FIG. 4.

As shown in the illustrative embodiment presented in FIGS. 3 and 4, each of the first and second housings 64, 66 are mechanically coupled to the nozzle housing by a coupling mechanism, which may include an extension arm 82, and a slot 84 in nozzle housing 50 engaged by extension arm 82. Each of the extension arms 82 may include one or more housing contact surfaces 86, which may slide along the sidewalls of slot 84, which may define nozzle contact surfaces 88. In such an embodiment, when the first and second housings 64, 66 are in the first or expanded position 70, the corresponding extension arms 82 will be in a relatively rearward position as shown in FIG. 3, and when the first and second housings 64, 66 are in the second or contracted position 72, the corresponding extension arms 82 will be in a relatively forward position as shown in FIG. 4. Thus, because the extension arms 82 are engaged with slot 84, the extension arms 82 move nozzle housing 50 towards the retracted position 60 as the housing contact surfaces 86 slide along the nozzle contact surfaces 88 when the first and second housings 64, 66 are moved towards first position 70, as shown in FIG. 3. Conversely, the extension arms 82 move nozzle housing 50 towards the extended position 62 as the housing contact surfaces 86 slide along the nozzle contact surfaces 88 when the first and second housings 64, 66 are moved towards second position 72, as shown in FIG. 4.

Pump 20 may be fluidly connected to the fluid reservoir 14 and the nozzle 16. The pump may be any suitable structure that causes a fluid to be discharged from nozzle 16. The pump may be configured in the form of a positive displacement pump, such as a piston pump, as shown in FIGS. 3 and 4. Pump 20 may include an inlet 90, an outlet 92 (not visible in FIGS. 3 and 4), a pump body 94, and a piston 96. The pump may also be configured as a dynamic pump, such as a centrifugal pump.

Figure 5:
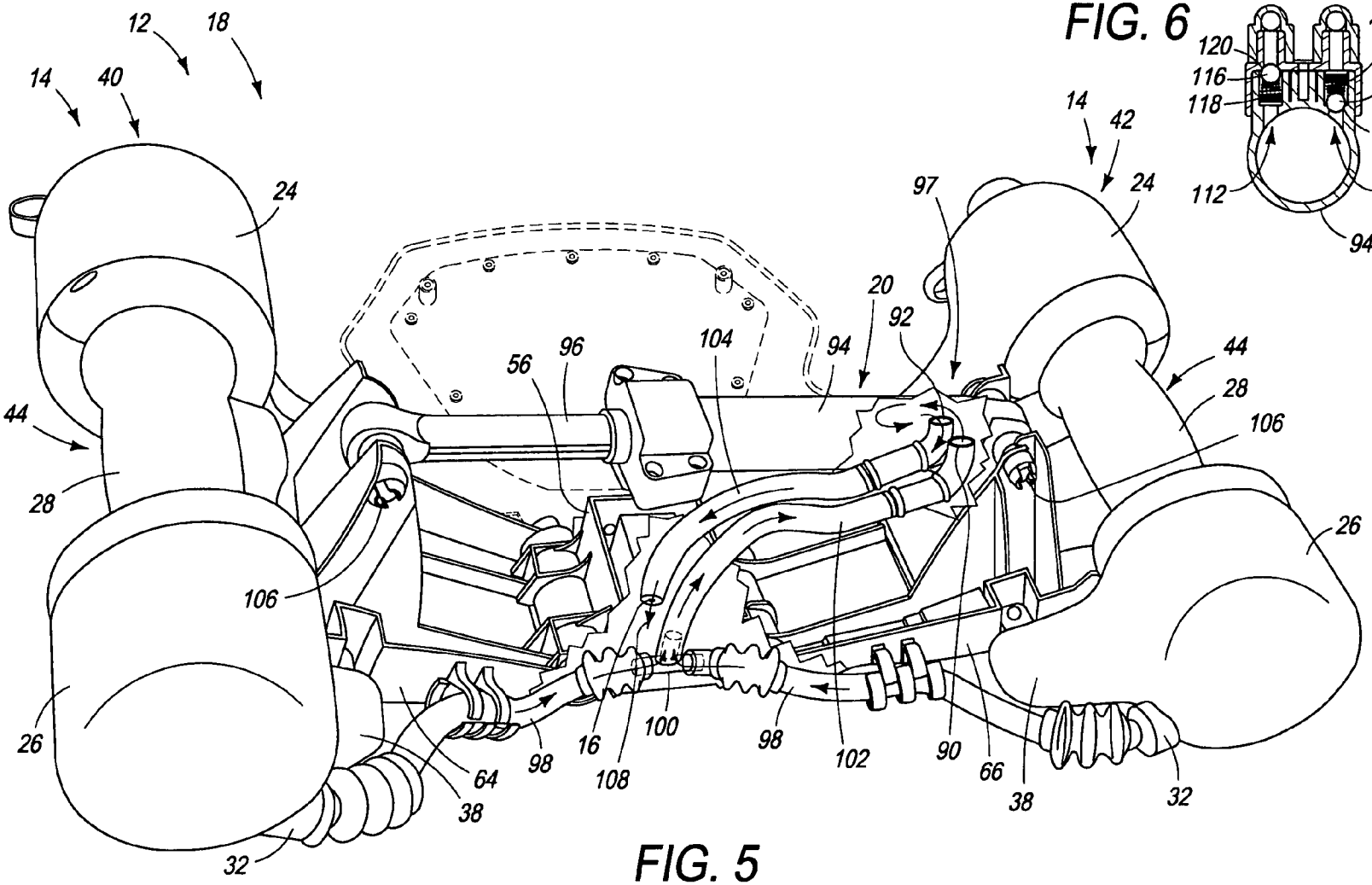
FIG. 5 is a partially cutaway lower-rear perspective view of the water gun of FIG. 1, with the fluid flow paths schematically illustrated with arrows.
Figure 7:
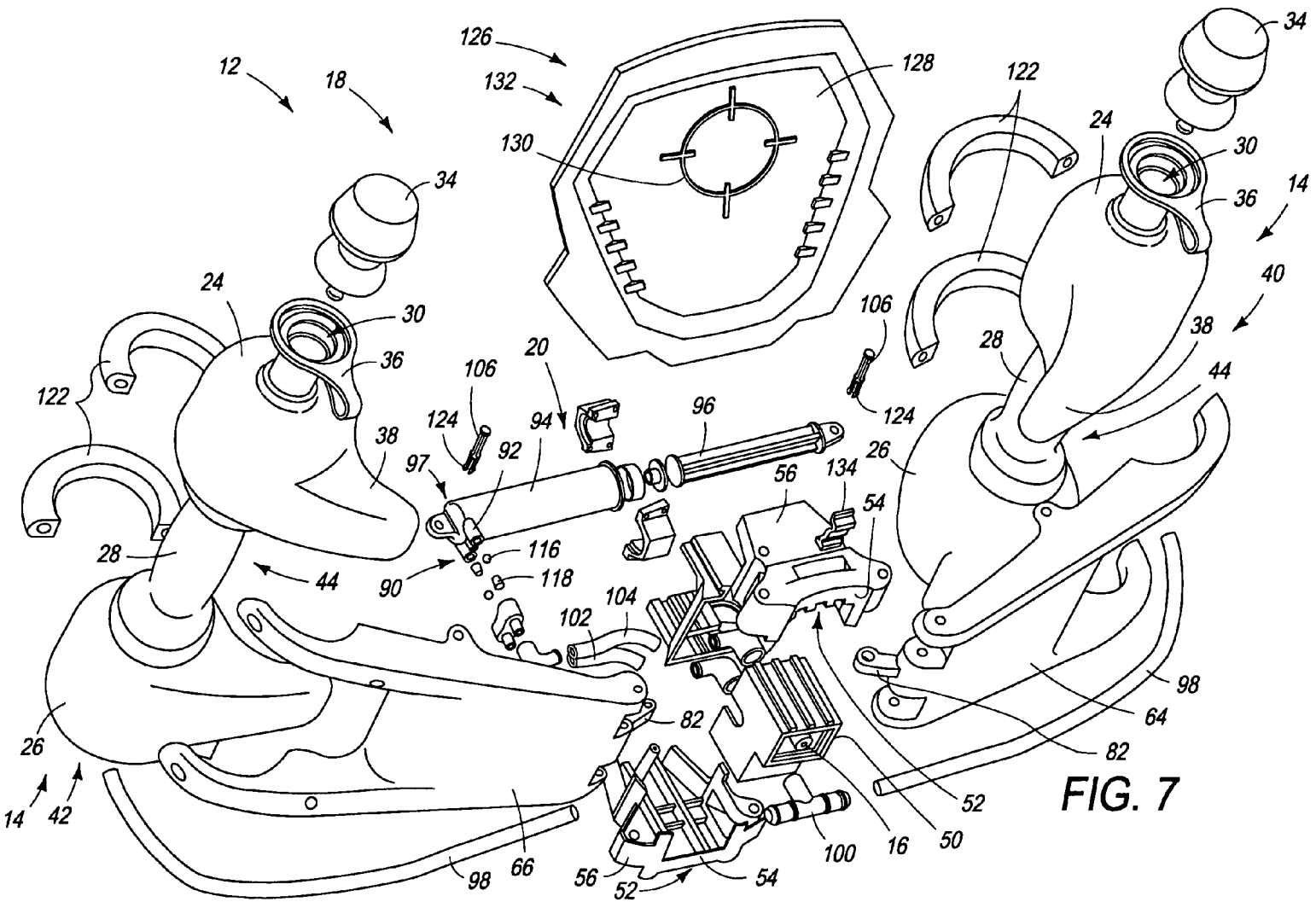
FIG. 7 is an exploded perspective view illustrating various components of a water gun similar to the water gun of FIG. 1.

As shown in the illustrative embodiment presented in FIGS. 3-5 and 7, inlet 90 may be disposed on pump body 94 proximate an end 97 of pump body 94. In some embodiments, outlet 92 may be disposed on pump body 94 proximate inlet 90, as shown in FIGS. 5 and 7.

As shown in FIG. 5, pump inlet 90 may be fluidly coupled to at least one of the fluid reservoirs 14 such as through fluid supply tubes 98, which may fluidly couple the outlets 32 of the first and second fluid reservoirs 40, 42 to a T-connector 100, and a pump inlet tube 102 which may be fluidly couple T-connector 100 to pump inlet 90. The pump outlet 92 may be fluidly coupled to nozzle 16, such as through a pump outlet tube 104.

As may be explained with reference to FIGS. 3-5, pump 20 may be configured to alternately draw a volume of fluid from at least one of the fluid reservoirs 14 and expel a volume of fluid through nozzle 16 in response to movement of actuator 18.

The piston 96 and pump body 94 may be pivotingly connected to the first and second housings 64, 66, respectively, such as with pump pivot pins 106, as shown in the illustrative embodiment presented in FIG. 5. When the first and second housings 64, 66 are transitioned from second position 72 toward first position 70, piston 96 is withdrawn from pump body 94, as illustrated in FIG. 3, such that a volume of fluid may be drawn from the first and second fluid reservoirs 40, 42 toward pump inlet 90, as shown in FIG. 5. Conversely, when the first and second housings 64, 66 are transitioned from first position 70 toward second position 72, piston 96 is driven into the pump body 94, as shown in FIG. 4, such that a volume of fluid may be delivered from pump outlet 92 toward nozzle 16 and discharged or expelled from nozzle 16, as shown generally at 108 in FIG. 5.

Figure 6:
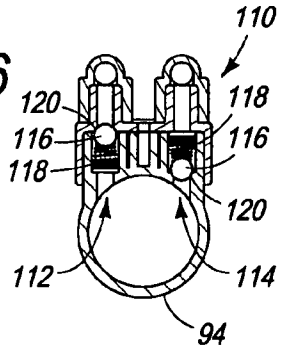
FIG. 6 is a partial section view of a pump valve assembly taken generally along line 6-6 in FIG. 3.

The alternate flow of fluid from fluid reservoir 14 toward pump inlet 90 and from pump outlet 92 toward nozzle 16 may be enabled by a valve assembly 110 on pump body 94, as shown in FIG. 6. Valve assembly 110 may include a pair of one-way valves, configured as respective inlet and outlet valves 112, 114. The inlet and outlet valves 112, 114 may be ball-valves, which each include a ball 116, a valve spring 118, and an annular valve seat 120.

At least one of the inlet and outlet valves 112, 114 may be proximate the end 97 of pump body 94, as shown in FIGS. 3-5 and 7. In some embodiments, outlet valve 114 may be proximate inlet valve 112. As shown in the illustrative embodiment presented in FIGS. 3-7, inlet valve 112 may be aligned relative to outlet valve 114, such as where inlet valve 112 is generally parallel to outlet valve 114.

As shown in the embodiment illustrated in FIG. 7, fluid reservoir 14 may be fabricated as a distinct or separate component which may be mechanically attached to the first and second housings 64, 66. In some examples, a supply hose may be used to connect pump 20 to a fluid source provided by a user. Fluid reservoir 14 may be clamped to the first or second housing 64, 66 using a pair of spaced apart mechanical supports, arms or clamps 122, which may be attached to the housing using a mechanical fastener, such as a screw, or an adhesive. In the example shown, the clamps 122 are spaced apart, forming a gap across which intermediate portion 28 of fluid reservoir 14 extends. When a mechanical fastener is used, the reservoirs 14 may be detachable from the housing. In some embodiments, fluid reservoir 14 may be at least partially integral to and form part of one or more of the first and second housings 64, 66.

In some embodiments, the pump pivot pins 106 may be configured to provide a removable connection between piston 96 and/or pump body 94 and the respective first and second housings 64, 66. As shown in FIG. 7, the pump pivot pins 106 may include a barbed end 124 to provide a removable snap-in engagement between the pump pivot pins 106 and the first and second housings 64, 66 such that piston 96 and/or pump body 94 may be disconnected from the respective first and second housings 64, 66.

In some embodiments, water gun 12 may include one or more shields 126, such as those illustrated in FIGS. 7-10. In some embodiments, at least some of the shields 126 may include a transparent region or window 128. The window 128 may include a crosshairs 130, as shown in FIG. 7.

As shown in FIG. 7, the one or more shields 126 may include a single shield 132, which may be attached to center housing 56, such as with shield hinge 134. Shield 132 may be configured to transition or move between a first or extended position and a second or retracted position. In the first or extended position a portion of the shield may be more closely perpendicular to the axis of nozzle 16, as generally indicated at 136 in FIG. 1. In the second or retracted position at least a portion of the shield may be more closely parallel to the axis of nozzle 16, as generally indicated at 138 in FIG. 1.

The shield 126 may be configured to be placed into various positions independently of the position of first and second housings 64, 66. The position of shield 126 may be maintained by a locking mechanism, such as series of mechanical detents or a friction stop, which may allow shield 126 to be maintained in any desirable position, such as one intermediate the first or extended position and the second or retracted position.

Figure 8:
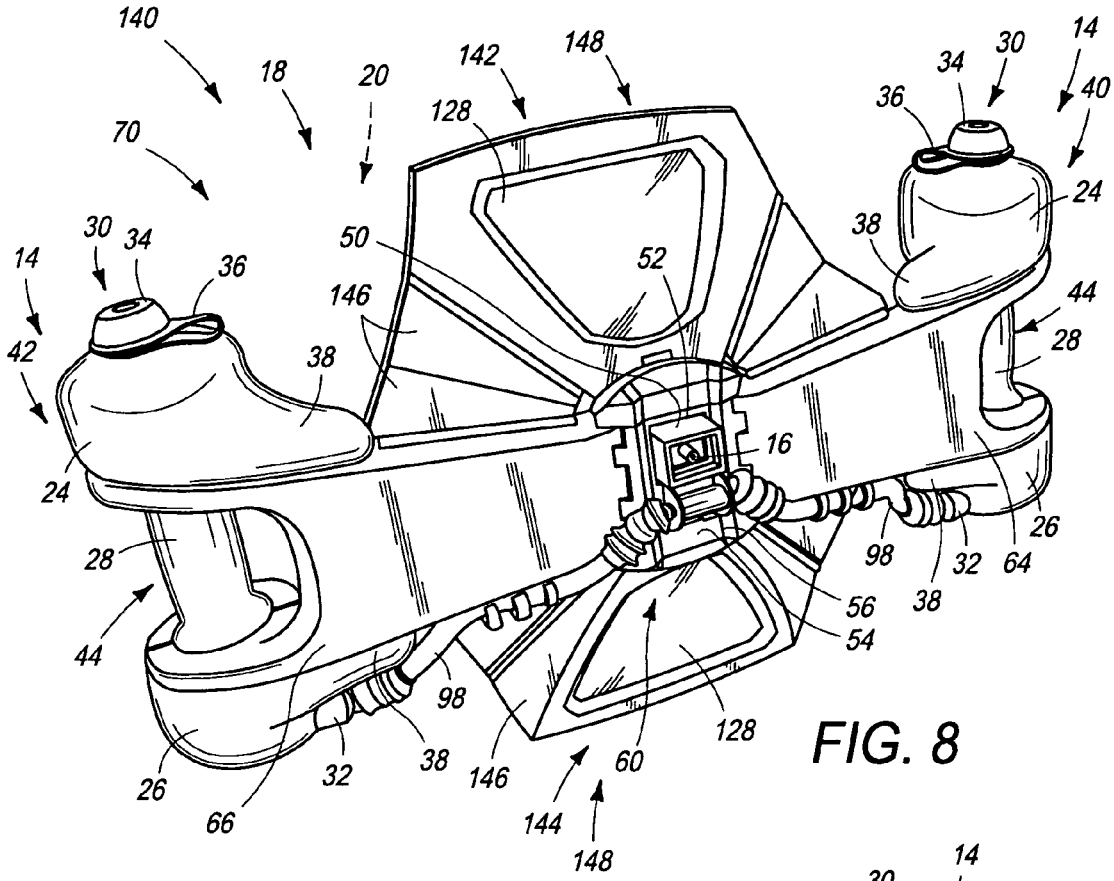
FIG. 8 is a top-front perspective view of another embodiment of a water gun shown with a nozzle in a retracted position.
Figure 9:
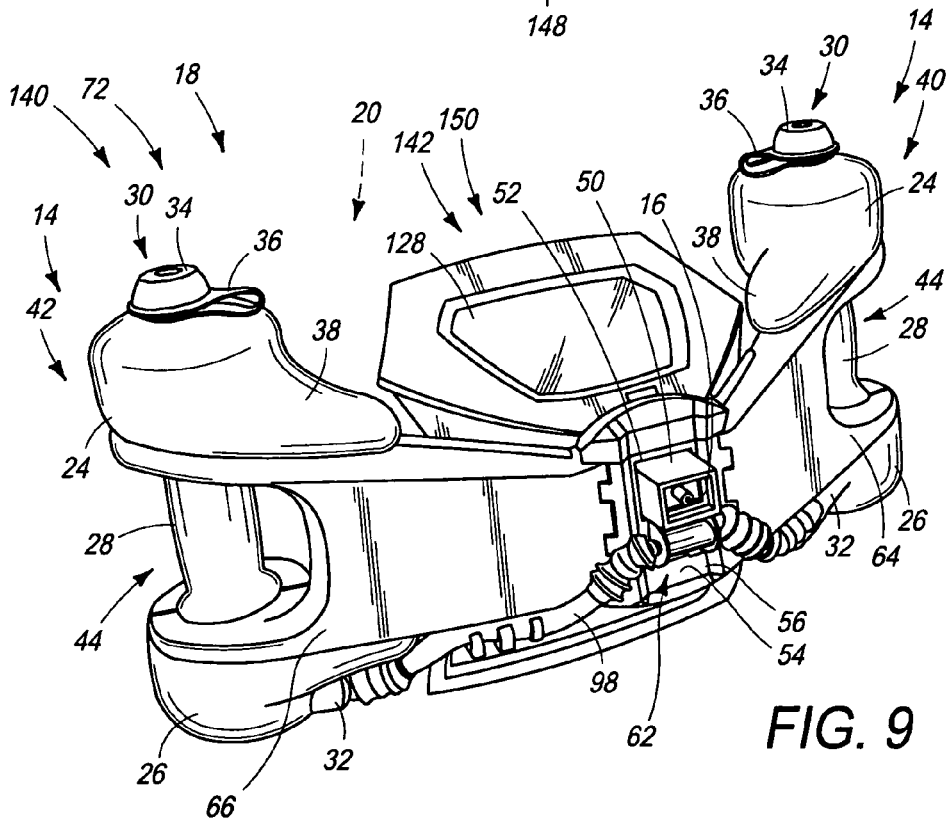
FIG. 9 is a top-front perspective view of the water gun of FIG. 8 shown with the nozzle in an extended position.
Figure 10:
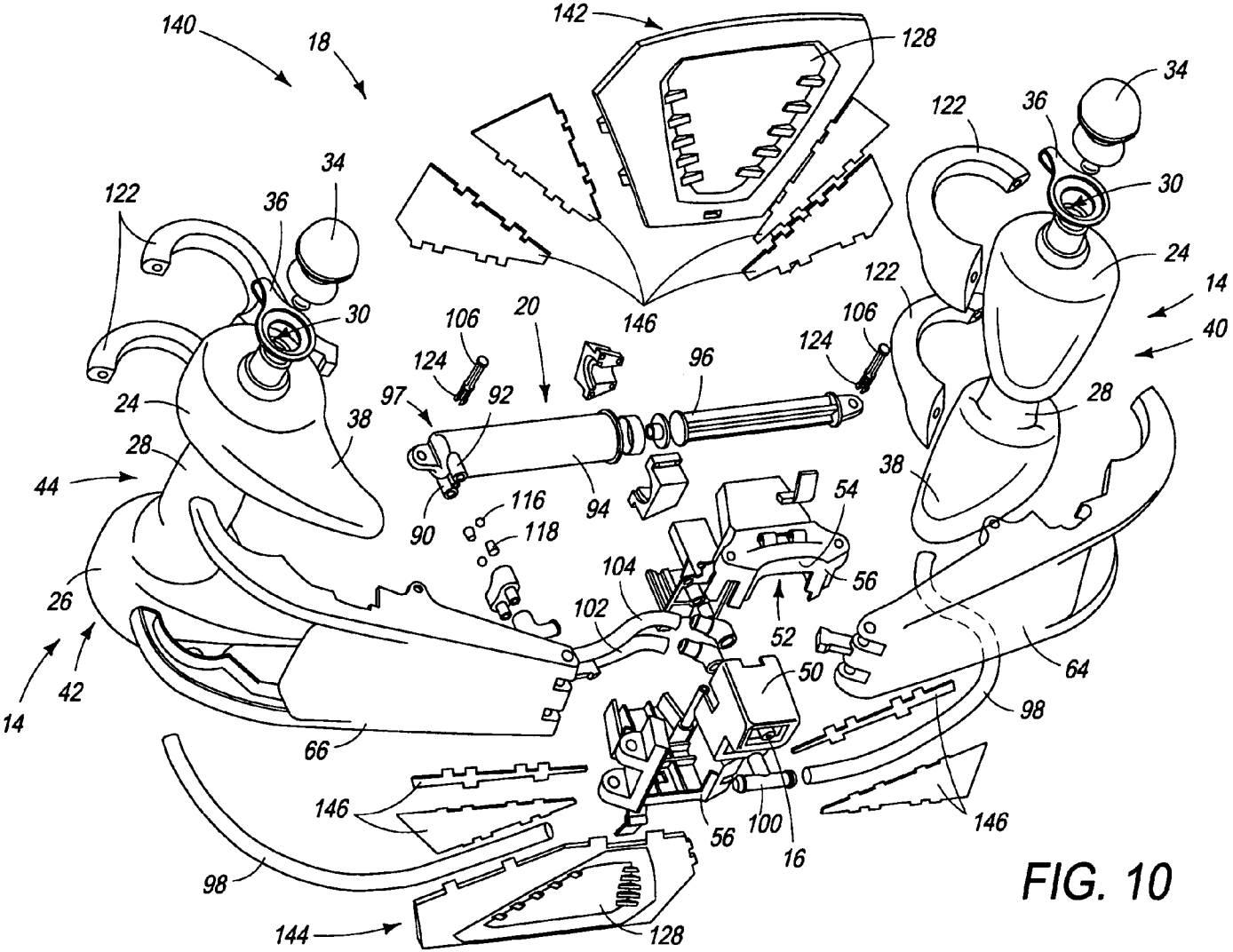
FIG. 10 is an exploded perspective view of the water gun of FIG. 8.

Another illustrative example of a water gun is shown at 140 in FIGS. 8-10. Water gun 140 may include a first shield 142, a second shield 144, and a plurality of triangular lateral shields 146, as shown in FIGS. 8-10.

The first and second shields 142, 144 may be hingedly attached to center housing 56, and the lateral shields 146 may be grouped in pairs where each of the lateral shields 146 may be hingedly attached to one of the first and second shields 142, 144 and one of the first and second housings 64, 66. In some embodiments not shown, lateral shields 146 may be used with only a first shield 142 and no second shield 144.

The shields may be configured to at least partially automatically extend and/or retract in response to the transition of the respective first and second housings 64, 66 between the first and second positions 70, 72, as illustrated in FIGS. 8 and 9. The shields may be configured to transition from a first or extended position 148, as shown in FIG. 8, toward a second or retracted position 150, as shown in FIG. 8, as the first and second housings 64, 66 transition from first position 70 toward second position 72. The automatic transition of the shields from the first or extended position 148 toward the second or retracted position 150 may be at least partially caused by geometric constraints imposed by the triangular lateral shields 146.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. A water gun, comprising:

a body having a front surface, the body and the front surface defining an opening;

a nozzle mounted to the body at least partially within the opening and extending from the body, and having at least a nozzle portion adapted to move relative to the opening between an extended position spaced away from the front surface and a retracted position closer to the front surface than the extended position;

an actuator pivotingly connected to the body and mechanically coupled to the nozzle for moving the nozzle between the retracted and extended positions when the actuator is pivoted between first and second positions; and a pump having an outlet fluidly coupled to the nozzle and an inlet, and responsive to movement of the actuator the pump expels a volume of fluid through the nozzle when the pump inlet is connected to a source of fluid and the actuator is pivoted between the first and second positions.

2. The water gun of claim 1, wherein the source of fluid comprises at least one fluid reservoir fluidly connected to the inlet, and responsive to movement of the actuator the pump draws a volume of fluid from the at least one fluid reservoir toward the inlet when the actuator is pivoted between the second and first positions.

3. The water gun of claim 1, wherein the actuator comprises:

a first housing and a second housing, the first and second housings being adapted to pivot in opposite directions relative to the body between a first position spaced away from a median plane of the water gun and a second position closer to the median plane.

4. The water gun of claim 3, wherein at least one of the respective first and second housings includes a housing contact surface; and the nozzle includes at least one nozzle contact surface, wherein motion of the housing contact surface along the at least one nozzle contact surface as the first and second housings move between their respective first and second positions causes the nozzle to move between the retracted position and the extended position.

5. The water gun of claim 1, wherein the nozzle moves relative to the body along a substantially rectilinear trajectory.

6. The water gun of claim 1, wherein the nozzle extends through the opening.

7. The water gun of claim 1, comprising at least one dumbbell-shaped fluid reservoir.

8. The water gun of claim 7, wherein the fluid reservoir is mounted on the actuator and a portion of the reservoir forms a handle adapted to be grasped by a human hand.

9. A water gun, comprising:

at least one fluid reservoir comprising discrete first and second end portions and a generally uniform elongate intermediate portion extending between the first and second end portions, the first and second end portions having volumes that are larger than the volume of the intermediate portion, wherein:

a longitudinal axis extends through the first and second end portions and through the intermediate portion, the first end portion has a first minimal radial dimension relative to the longitudinal axis, the second end portion has a second minimal radial dimension relative to the longitudinal axis, the intermediate portion has a maximal radial dimension relative to the longitudinal axis, and the maximal radial dimension of the intermediate portion is shorter than either of the first and second minimal radial dimensions;

a nozzle; and a pump fluidly coupled to the at least one reservoir and the nozzle, the pump being operable to discharge fluid received from the at least one reservoir through the nozzle.

10. The water gun of claim 9, wherein at least a portion of at least one of the respective first and second end portions has a radially asymmetric cross-section.

11. The water gun of claim 9, wherein the pump is configured to alternately draw a volume of fluid from the at least one fluid reservoir and expel a volume of fluid through the nozzle.

12. The water gun of claim 11, comprising a first housing and a second housing, each of the respective first and second housings adapted to pivot relative to the nozzle between a first position in which at least a portion of each of the respective first and second housings extends away from a median plane of the water gun and a second position in which the portion is closer to the median plane.

13. The water gun of claim 12, wherein there is at least one of the at least one fluid reservoir disposed on each of the first and second housings.

14. The water gun of claim 9, wherein the nozzle is adapted to move relative to a body between an extended position in which at least a portion of the nozzle extends away from a front surface of the body and a retracted position in which the portion of the nozzle is closer to the front surface.

15. A water gun, comprising:

a body having a front surface;

a first housing having at least a first portion configured to move relative to the body between a first position in which the first portion of the first housing is spaced a first direction away from a median plane of the water gun and a second position closer to the median plane than the first position of the first housing;

a second housing having at least a first portion configured to move relative to the body between a first position in which the first portion of the second housing is spaced a second direction opposite to the first direction away from the median plane of the water gun and a second position closer to the median plane than the first position of the second housing;

at least one fluid reservoir supported on at least one of the first and second housings;

a nozzle supported on the body and having at least a nozzle portion adapted to move along the median plane relative to the body between an extended position in which the nozzle portion is spaced away from the front surface and a retracted position in which the nozzle portion is closer to the front surface than the extended position;

a pump fluidly coupling the reservoir and the nozzle and configured to discharge water from the nozzle when the nozzle portion moves between the retracted and extended positions; and at least one of the first and second housings being mechanically coupled to the nozzle for moving the nozzle between the retracted and extended positions when the at least one of the first and second housings moves between the first and second positions.

16. The water gun of claim 15, comprising a pump having an inlet fluidly connected to the at least one fluid reservoir and an outlet fluidly connected to the nozzle, wherein the pump is configured to:

draw fluid from the at least one fluid reservoir toward the inlet as the nozzle portion moves between the extended and retracted positions; and deliver fluid from the outlet toward the nozzle as the nozzle portion moves between the extended and retracted positions.

17. The water gun of claim 15, wherein the nozzle portion moves relative to the body along a substantially rectilinear trajectory.

18. The water gun of claim 15, wherein the at least one fluid reservoir comprises:

an upper portion;

a lower portion; and a middle portion intermediate the respective upper and lower portions, wherein the middle portion has a reduced cross-section relative to at least one of the respective upper and lower portions, the middle portion being adapted to be grasped by a human hand.

19. A water gun, comprising:

a nozzle;

a source of fluid, wherein the source of fluid comprises at least one dumbbell-shaped fluid reservoir comprising first and second end portions and a generally uniform elongate intermediate portion extending between the first and second end portions, the first and second end portions having volumes that are larger than the volume of the intermediate portion; and a pump, comprising:

a pump body having an end;

an inlet fluidly coupled to the source of fluid, the inlet being disposed on the pump body proximate the end; and an outlet fluidly coupled to the nozzle, the outlet being disposed on the pump body proximate the inlet.

20. The water gun of claim 19, wherein the source of fluid comprises at least one fluid reservoir and the pump is adapted to alternately draw a volume of fluid from the at least one fluid reservoir and expel a volume of fluid through the nozzle.

21. The water gun of claim 19, comprising:

a body, wherein the nozzle is disposed on the body; and an actuator adapted to move relative to the body, wherein responsive to movement of the actuator the pump expels a volume of fluid through the nozzle when the actuator is moved between a first position and a second position.

22. The water gun of claim 1, wherein the actuator moves the nozzle from the retracted position toward the extended position when the actuator is pivoted from the first position toward the second position, and the actuator moves the nozzle from the extended position toward the retracted position when the actuator is pivoted from the second position toward the first position.

23. The water gun of claim 1, wherein the actuator retains the nozzle in the extended position when the actuator is retained in the second position.

24. A water gun, comprising:

a body having a front surface, the body and the front surface defining an opening;

a nozzle mounted to the body at least partially within the opening and extending from the body, and having at least a nozzle portion adapted to move relative to the opening between an extended position spaced away from the front surface and a retracted position closer to the front surface than the extended position; and an actuator pivotingly connected to the body and mechanically coupled to the nozzle for moving the nozzle between the retracted and extended positions when the actuator is pivoted between first and second positions, wherein the actuator comprises a first housing and a second housing, the first and second housings being adapted to pivot in opposite directions relative to the body between a first position spaced away from a median plane of the water gun and a second position closer to the median plane.

25. The water gun of claim 24, wherein at least one of the respective first and second housings includes a housing contact surface; and the nozzle includes at least one nozzle contact surface, wherein motion of the housing contact surface along the at least one nozzle contact surface as the first and second housings move between their respective first and second positions causes the nozzle to move between the retracted position and the extended position.

26. A water gun, comprising:

a body having a front surface, the body and the front surface defining an opening;

a nozzle mounted to the body at least partially within the opening and extending from the body, and having at least a nozzle portion adapted to move relative to the opening between an extended position spaced away from the front surface and a retracted position closer to the front surface than the extended position;

an actuator pivotingly connected to the body and mechanically coupled to the nozzle for moving the nozzle between the retracted and extended positions when the actuator is pivoted between first and second positions; and at least one dumbbell-shaped fluid reservoir.

27. The water gun of claim 26, wherein the fluid reservoir is mounted on the actuator and a portion of the reservoir forms a handle adapted to be grasped by a human hand.

* * * * *